US005947761A

United States Patent [19]

Pepe

[11] Patent Number: 5,947,761

[45] Date of Patent: Sep. 7, 1999

[54] ELECTRICAL CONNECTOR WITH PIVOTING WIRE FIXTURE

[75] Inventor: Paul J. Pepe, Winston-Salem, N.C.

[73] Assignee: The Whitaker Corporation, Wilmington, Del.

[21] Appl. No.: 09/162,516

[22] Filed: Sep. 29, 1998

[51] Int. Cl.[6] ..... H01R 4/24

[52] U.S. Cl. ..... 439/409; 439/942

[58] Field of Search ..... 439/409, 399, 439/407, 942

[56] References Cited

U.S. PATENT DOCUMENTS

| | | | |
|---|---|---|---|
| 4,426,125 | 1/1984 | Crawford | 339/99 R |
| 4,541,679 | 9/1985 | Fiedler et al. | 339/97 P |
| 4,684,195 | 8/1987 | Anderson et al. | 439/404 |
| 4,874,329 | 10/1989 | Yu | 439/409 |
| 4,975,078 | 12/1990 | Stroede et al. | 439/405 |
| 4,995,829 | 2/1991 | Geib et al. | 439/409 |
| 5,118,310 | 6/1992 | Stroede et al. | 439/676 |
| 5,358,430 | 10/1994 | Bonvallat et al. | 439/676 |
| 5,435,747 | 7/1995 | Franckx | 439/409 |
| 5,662,493 | 9/1997 | Reichle | 439/409 |
| 5,667,402 | 9/1997 | Denovich et al. | 439/409 |
| 5,762,518 | 6/1998 | Tanigawa et al. | 439/409 |
| 5,791,943 | 8/1998 | Lo et al. | 439/676 |

*Primary Examiner*—Neil Abrams
*Assistant Examiner*—J. F. Duverne
*Attorney, Agent, or Firm*—Robert J. Kapalka

[57] ABSTRACT

An electrical connector for terminating a plurality of wires (4) includes a housing (10) which holds a plurality of insulation displacement contacts (52) that are associated with respective ones of the wires. The contacts are arranged in two spaced-apart rows (55, 56). A fixture (16) is pivotally connected to the housing. The fixture has an array of first slots (82) and an array of second slots (86). The arrays of slots are spaced-apart. The first slots (82) are axially aligned with respective ones of the second slots (86) to define pairs of axially aligned spaced-apart slots. The wires (4) can be laced into respective ones of the pairs of slots (82, 86) when the fixture (16) is in an open position, and the slots are arranged such that the wires become terminated to respective ones of the contacts (52) when the fixture is pivoted to a closed position.

10 Claims, 4 Drawing Sheets

ELECTRICAL CONNECTOR WITH PIVOTING WIRE FIXTURE

FIELD OF THE INVENTION

The invention relates to an electrical connector having insulation displacement contacts and a cover which includes a fixture for holding wires in proper position for termination to the contacts.

BACKGROUND OF THE INVENTION

Many electrical connectors for use in a communications system have insulation displacement contacts which can be terminated to individual wires in the system. The wires must be driven into the contacts with some force so that the insulation on each wire will be pierced by its contact and the contact will electrically engage the conductive core of the wire. Various tools have been used for driving the wires into engagement with the contacts. Further, each of the wires must be terminated to a specific contact so that communications circuits are not crossed in the connector. A number of connectors have a fixture which holds a plurality of wires in a fixed array. The fixture is driven toward the insulation displacement contacts to terminate all of the wires to their respective contacts in a single insertion stroke. See, for example, U.S. Pat. Nos. 4,975,078; 5,118,310; and 5,762,518. A problem with these connectors is that a substantial force is required to drive the fixture toward the contacts, and use of a tool to drive the fixture is often required. Further, these connectors are used with communications wires which are twisted together as pairs of wires comprising signal pairs. Twisted pairs of wires are effective for minimizing crosstalk in a communications system. A problem arises in that the wires must be untwisted prior to insertion in the fixture, and any untwist in the wires has a detrimental effect upon signal integrity. There is a need for a connector which minimizes the untwisted length of wires that are terminated to contacts in the connector.

SUMMARY OF THE INVENTION

According to one aspect, an electrical connector for terminating a plurality of wires comprises a housing which holds a plurality of insulation displacement contacts that are associated with respective ones of the wires. The contacts are arranged in two spaced-apart rows, and each of the rows includes multiple ones of the contacts. A fixture is pivotally connected to the housing. The fixture has an array of first slots and an array of second slots. The arrays are spaced-apart. The first slots are axially aligned with respective ones of the second slots to define pairs of axially aligned spaced-apart slots. The wires can be laced into respective ones of the pairs of slots when the fixture is in the open position, and the slots are arranged such that the wires become terminated to respective ones of the contacts when the fixture is pivoted to the closed position.

According to another aspect, an electrical connector for terminating a plurality of wires that are arranged as twisted wire pairs comprises a housing which holds a plurality of insulation displacement contacts that are associated with respective ones of the wires. The contacts are arranged in two spaced-apart rows. A fixture is pivotally connected to the housing. The fixture has a wall and passages extending through the wall. Each of the passages has a cross-section which is dimensioned to permit one of the twisted wire pairs to extend through the passage, and each of the passages has a divider that bisects the passage to define two first slots at a downstream end of the passage. Each of the first slots is axially aligned with a respective second slot which is spaced-apart from the first slot to define a pair of axially aligned spaced-apart slots. Each of the twisted wire pairs can be untwisted and the individual wires can be laced into respective ones of the pairs of slots when the fixture is in the open position, and the slots are arranged such that the wires become terminated to respective ones of the contacts when the fixture is pivoted to the closed position.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
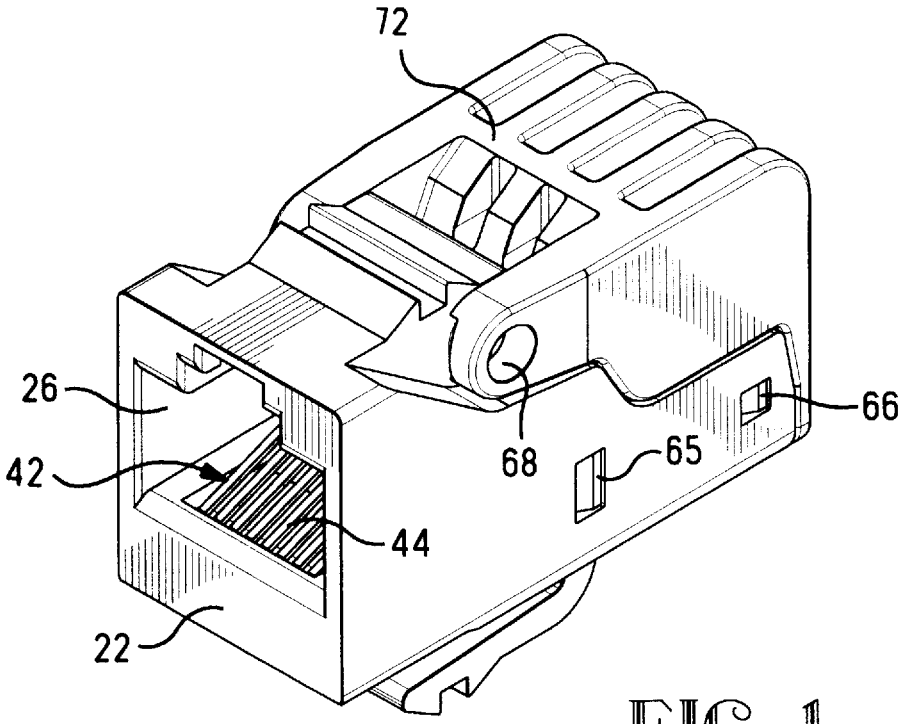
FIG. 1 is a front isometric view of an electrical connector having a wire fixture according to the invention, with the fixture in a closed position.

There is shown in FIGS. 1–5 an electrical connector of a type which is commonly known as a telephone modular jack. As best seen in exploded views in FIGS. 2 and 5, the connector comprises a dielectric housing 10, a terminal insert 12, a contact subassembly 14, and a wire fixture 16.

The housing 10 includes a receptacle portion 18 and a platform portion 20. The receptacle portion has a front face 22, a rear face 24, and a cavity 26 which opens into the receptacle portion though the front face. The cavity is configured as a receptacle for a mating modular plug (not shown). On top of the receptacle portion 18 is a pivot block 28 which has a pair of journals 30 extending from opposite sides thereof (only one of the journals 30 being visible in the drawings). The platform portion 20 is disposed at a rear of the receptacle portion 18. The platform portion includes a bottom wall 32 and side walls 34 which have openings 35, 36.

The terminal insert 12 includes a circuit board 38 and a dielectric carrier 40 which holds a plurality of terminals 42 in an array. The terminals 42 have contact sections 44 which are adjacent to free ends 46, and opposite ends 48 which are electrically connected to circuit traces (not shown) on the circuit board.

The contact subassembly 14 includes a dielectric contact holder 50 which holds a plurality of insulation displacement contacts 52. Each of the contacts has a split beam which defines a slot 54 that can receive a wire. Edges of the split beam on opposite sides of the slot are configured to slice the insulation jacket on a wire which is installed in the slot and to electrically engage the wire conductive core.

The contacts 52 are arranged in the holder in two laterally extending rows comprising a first row 55 and a second row 56 which are spaced-apart along a longitudinal axis of the connector. The contact holder 50 includes a separator wall 58 between the two rows 55, 56. The rows extend parallel to each other, and there are four contacts 52 in each row. The rows of contacts are laterally offset with respect to each other, whereby longitudinal centerlines of the contact slots 54 are laterally spaced-apart at a constant pitch.

Each of the contacts 52 has a solder tail 60 which is received in a through-hole 39 in the circuit board 38 and electrically terminated to a respective trace (not shown) on the circuit board by soldering. In this way, the contacts 52 are electrically connected to respective ones of the terminals 42 by traces on the circuit board. Also, the terminal insert 14 and the contact subassembly 16 are mechanically joined together prior to installation in the housing 10.

Figure 2:
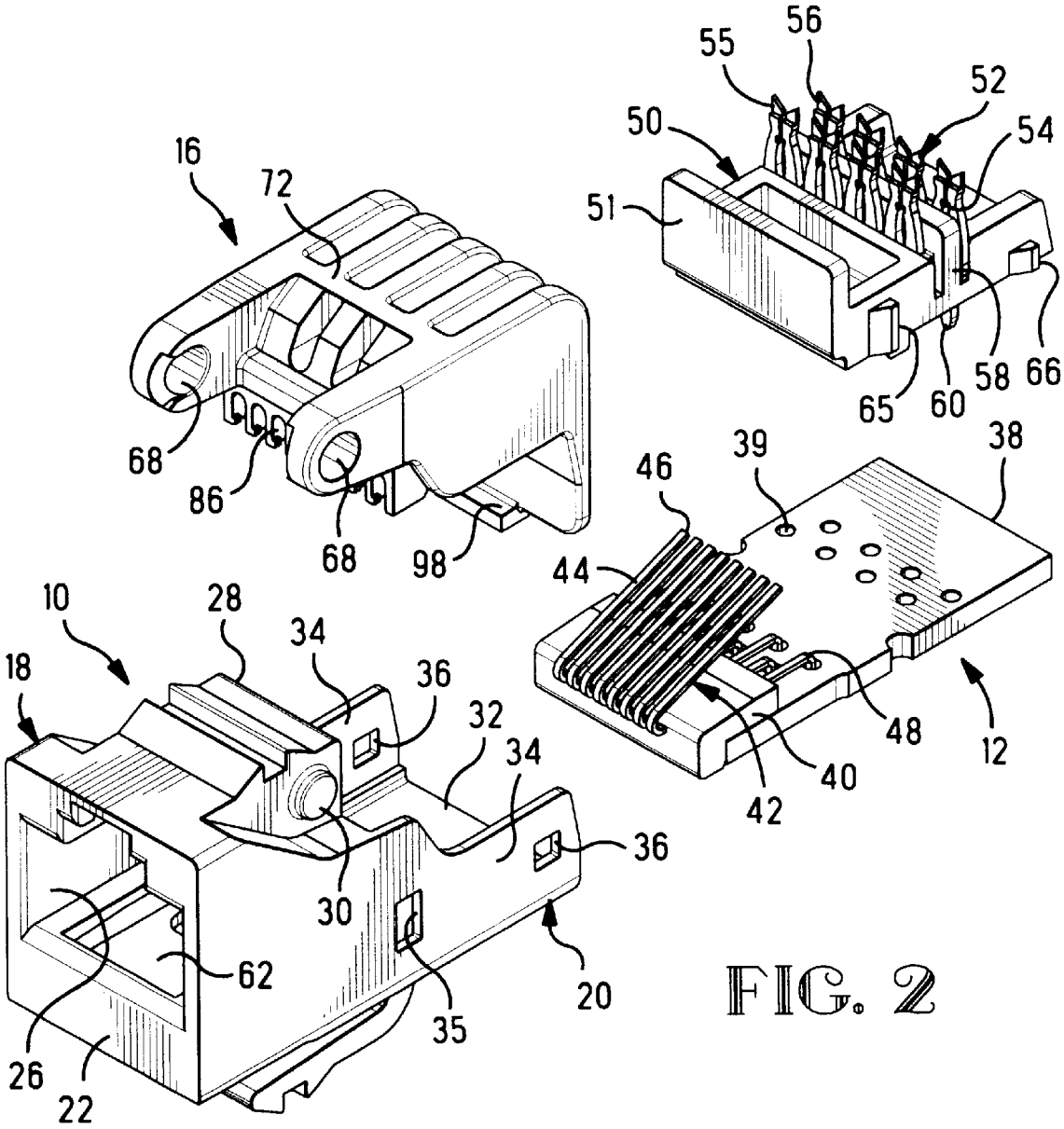
FIG. 2 is an exploded isometric view of the connector from the perspective of FIG. 1.
Figure 4:
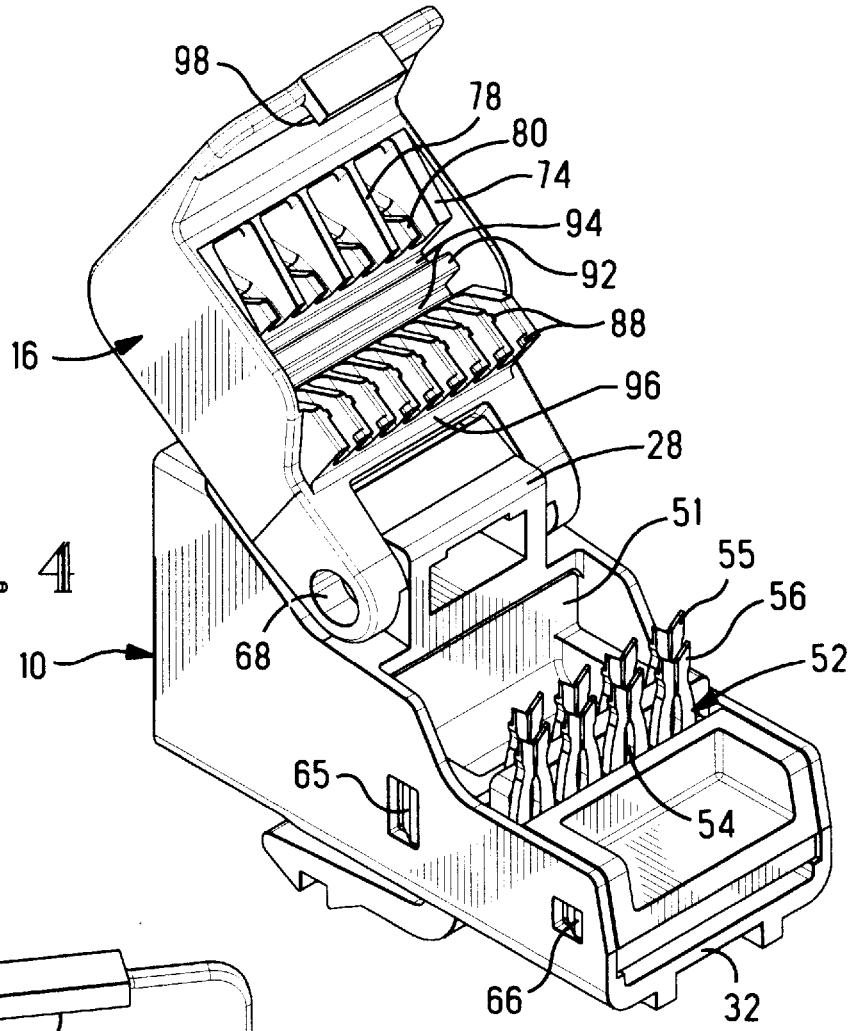
FIG. 4 is a rear isometric view of the connector with the fixture in the open position.
Figure 5:
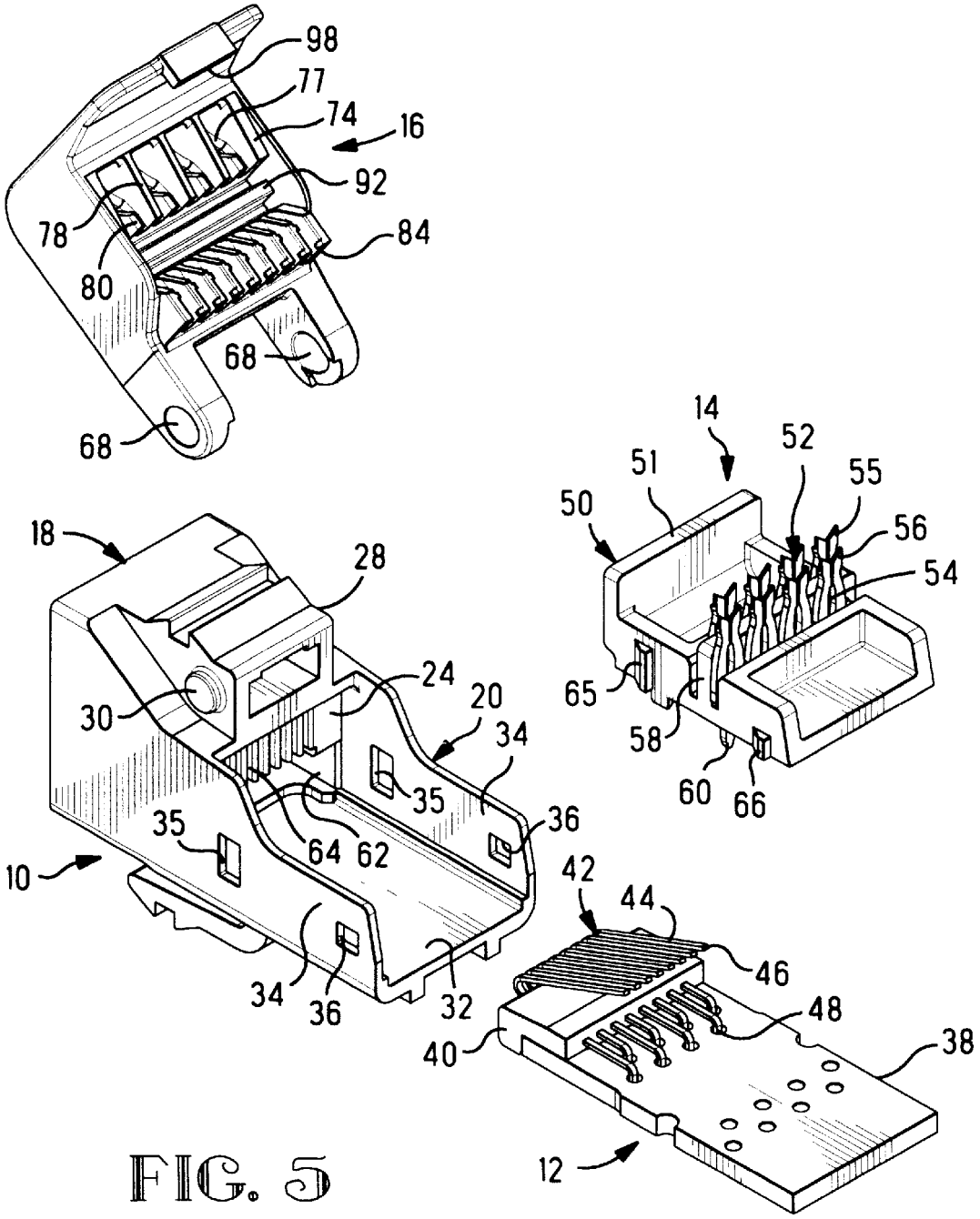
FIG. 5 is an exploded isometric view of the connector from the perspective of FIG. 4.

As best seen in FIG. 5, the housing 10 has a cavity 62 and a plurality of slots 64 which open through the rear face 24. The cavity 62 is open to a bottom of the cavity 26 which extends through the front face 22, as shown in FIG. 2. The terminals 42 at a leading end of the terminal insert 14 are installed in the housing through the opening 62. The free ends 46 of the terminals enter the slots 64 and are guided and stabilized in the housing by walls of the slots 64. The circuit board 38 resides on the bottom wall 32 of the platform section 20. The contact holder 50 has latch tabs 65, 66 which engage in the openings 35, 36, respectively, in the side walls of the platform section to secure the terminal insert and contact holder in the housing. The contact holder has a wall 51 which confronts the rear face 24 of the housing and closes off the slots, as shown in FIG. 4.

Figure 3:
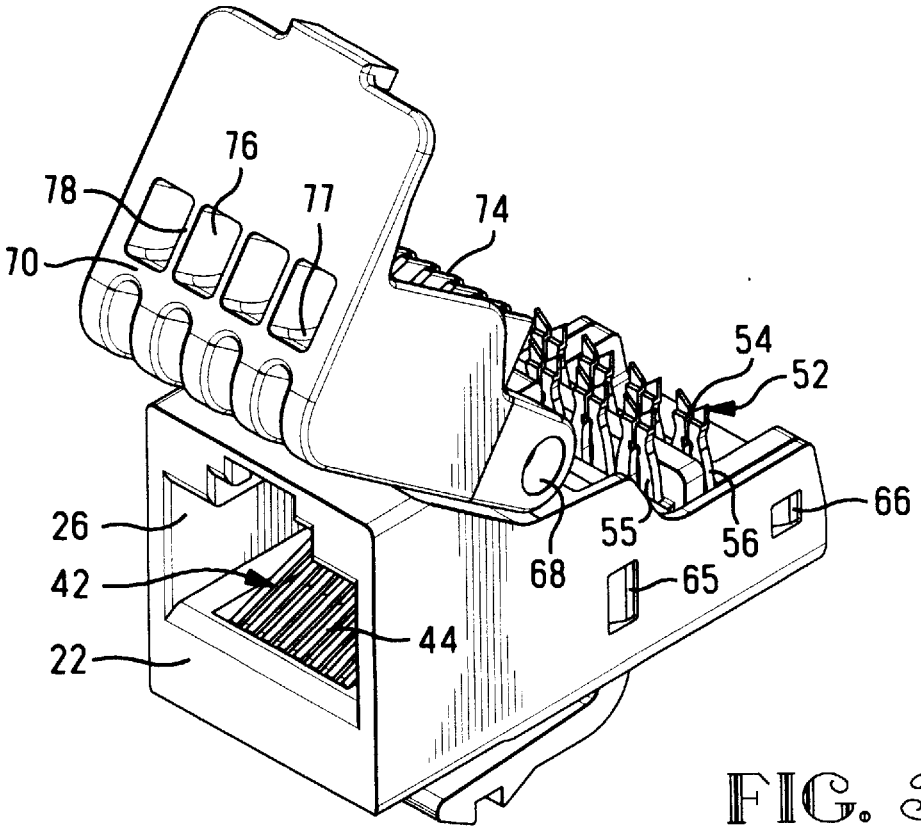
FIG. 3 is a front isometric view of the connector with the fixture in an open position.

The wire fixture 16 is a dielectric member which is pivotally attached to the housing 10 by a yoke having two bores 68 which receive the journals 30 extending from the pivot block 28. The wire fixture 16 is pivotable from a full open position as shown in FIG. 3 to a closed position as shown in FIG. 1. The wire fixture is pivotable through an angle of approximately 150°.

Figure 6:
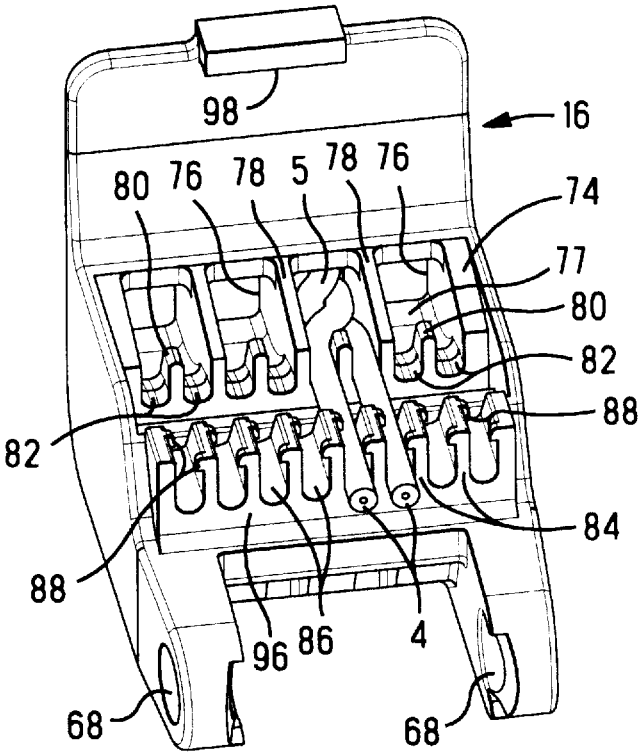
FIG. 6 is an isometric view of an underside of the fixture showing an exemplary pair of wires laced in the fixture.

For reference purposes the wire fixture 16 will be designated as having a wire insertion face 70 along a rear wall, a topside 72 and an underside 74. Referring also to FIG. 6, the wire fixture has passages 76 which are separated by walls 78. The passages 76 extend through the rear wall for a length downstream from the wire insertion face 70. The passages 76 are open along the underside 74 of the wire fixture for a significant portion of their length. Within each passage is a first divider 80 which is disposed downstream from the wire insertion face 70. Each of the passages has a cross-section which is dimensioned to receive a respective twisted pair of wires which are installed through the wire insertion face. The first dividers 80 bisect the passages 76 to define a pair of wire-receiving slots 82 flanking each of the first dividers at downstream ends of the passages. Thus, the first dividers 80 and the walls 78 define an array of first wire-receiving slots 82 which are open to the underside 74 of the wire fixture. Each of the first slots 82 has a cross-section which is dimensioned to accommodate only one wire of the twisted wire pair which is received in the associated passage 76.

Each one of the walls 78 and the first dividers 80 is aligned with a respective second divider 84 which is disposed further downstream along the underside 74 of the wire fixture. The second dividers 84 define an array of second wire-receiving slots 86 which are open to the underside of the wire fixture. Each of the second wire-receiving slots 86 is axially aligned with one of the first wire-receiving slots 82, thereby forming an axially aligned pair of first and second wire-receiving slots. Each of the second wire-receiving slots has a cross-section which is dimensioned to accommodate only the single wire which is received in its associated first wire-receiving slot. Thus, each pair of axially aligned first and second slots comprises a nest for a single wire. Also, each pair of axially aligned first and second slots is associated with a respective one of the contacts 52 in the connector. The second dividers 84 have wire retention nubs 88 which serve to retain the wires in the second wire-receiving slots as will be described.

The second dividers 84 are separated from the walls 78 and the first dividers 80 by a longitudinal gap. Within the gap is a stuffer wall 92 which extends laterally across the gap. The stuffer wall 92 divides the gap 90 into a pair of parallel-extending spaces 94. When the fixture 16 is in the closed position, the stuffer wall 92 overlies the separator wall 58 of the contact holder 50 and is in close proximity thereto. Also, the first and second rows of contacts 55, 56 are received in the spaces 94.

Installation of communications wires into the fixture 16 will now be discussed. With the fixture in the open position as shown in FIG. 3, twisted pairs of wires are inserted into the passages 76 through the wire insertion face 70 and through the rear wall. Each twisted pair is inserted into a respective one of the passages, and the wires remain twisted during insertion. A roof 77 of each passage is angled downward to guide the twisted wire pairs through the open undersides of the passages until short lengths of twisted wire pairs are exposed at the underside 74 of the fixture. These short lengths are untwisted, and each pair of wires is separated so that they flank one of the first dividers 80. Then, the wires are pulled downstream to bring twisted portions of the wires into engagement with the first dividers 80. This procedure serves to minimize the lengths of the untwisted wire portions in the connector. Next, the untwisted wires are laced into respective pairs of axially aligned first slots 82 and second slots 86. The wires must be urged past the retention nubs 88 on the second dividers, and the wires are retained in the second slots 86 by the nubs. Ends of the wires which extend beyond the second dividers are severed along end face 96 of the second dividers with a suitable tool. An exemplary pair of wires 4 which are twisted together at 5 are shown fully laced in the fixture in FIG. 6.

After being laced into the slots 82 and 86, the wires are positioned for insertion into the slots 54 of the insulation displacement contacts. Pivoting the wire fixture to the closed position urges the wires into the slots 54 and into engagement with the insulation displacement contacts. The stuffer wall 92 pushes the wires into the slots during pivoting of the fixture. A significant force is required to push the wires into the slots 54. Due to the changing angular relationship between the wires and the contacts during pivoting of the fixture, the wires associated with the first row of contacts 55 enter these contacts slightly ahead of the wires that enter the second row of contacts 56. This stagger in wire entry serves to lower the maximum insertion force which is encountered during pivoting of the fixture to the closed position.

The fixture 16 has a latch 98 which engages below the bottom wall 32 of the housing to retain the fixture in the closed position.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector for terminating a plurality of wires, the connector comprising:

a housing having a front face and a cavity which opens through the front face;

a terminal insert carried by the housing, the terminal insert including a plurality of terminals having contact sections which are disposed in the cavity and opposite end portions which are connected to a circuit board;

a plurality of insulation displacement contacts that are associated with respective ones of the wires, the insulation displacement contacts being mounted on the circuit board and electrically connected with respective ones of the plurality of terminals, the insulation displacement contacts being arranged in two spaced-apart rows, each of the rows including multiple ones of the insulation displacement contacts; and a fixture pivotally connected to the housing, the fixture having an array of first slots and an array of second slots, the arrays being spaced-apart, the first slots being axially aligned with respective ones of the second slots to define pairs of axially aligned spaced-apart slots, whereby the wires can be laced into respective ones of the pairs of slots when the fixture is in an open position, and the slots are arranged such that the wires become terminated to respective ones of the insulation displacement contacts when the fixture is pivoted to a closed position.

2. The electrical connector according to claim 1, wherein the fixture has a wall and passages extending through the wall, each of the passages has a cross-section which is dimensioned to receive a twisted pair of the wires, and each of the passages is aligned with two of the pairs of slots, whereby the twisted pair of wires can be untwisted and each of the wires can be received in a respective one of the pair of slots.

3. The electrical connector according to claim 2, wherein a first divider is disposed in each of the passages, and a pair of the first slots are defined on respective opposite sides of the first divider.

4. The electrical connector according to claim 1, wherein the fixture includes a stuffer wall which is disposed in a gap between the array of first slots and the array of second slots.

5. The electrical connector according to claim 1, wherein the cavity is configured as a receptacle for a modular plug.

6. The electrical connector according to claim 1, wherein the fixture is pivotable through an angle greater than ninety degrees.

7. An electrical connector for terminating a plurality of wires that are arranged as twisted wire pairs, the connector comprising:

a housing which holds a plurality of insulation displacement contacts that are associated with respective ones of the wires, the contacts being arranged in two spaced-apart rows, a fixture pivotally connected to the housing, the fixture having a wall and passages extending through the wall, each of the passages having a cross-section which is dimensioned to permit one of the twisted wire pairs to extend through the passage, each of the passages having a divider that bisects the passage to define two first slots at a downstream end of the passage, each of the first slots being axially aligned with a respective second slot which is spaced-apart from the first slot to define a pair of axially aligned spaced-apart slots, whereby each of the twisted wire pairs can be untwisted and the individual wires can be laced into respective ones of the pairs of slots when the fixture is in an open position, and the slots are arranged such that the wires become terminated to respective ones of the contacts when the fixture is pivoted to a closed position.

8. The electrical connector according to claim 7, wherein the fixture includes a stuffer wall which is disposed in a gap between the first slots and the second slots.

9. The electrical connector according to claim 7, wherein the housing includes a receptacle for a modular plug.

10. The electrical connector according to claim 7, wherein the fixture is pivotable through an angle greater than ninety degrees.

* * * * *